US005558012A

United States Patent [19]

Yamashima et al.

[11] Patent Number: 5,558,012

[45] Date of Patent: Sep. 24, 1996

[54] AUTOMATIC BUNDLING MACHINE

[75] Inventors: Osamu Yamashima; Toshihiro Inoue; Hiroshi Hasegawa, all of Haibara-gun, Japan

[73] Assignee: Yazaki Corporation, Tokyo, Japan

[21] Appl. No.: 409,093

[22] Filed: Mar. 23, 1995

[30] Foreign Application Priority Data

Mar. 24, 1994 [JP] Japan ..... 6-053593

[51] Int. Cl.[6] ..... B65B 13/28

[52] U.S. Cl. ..... 100/26; 53/138.8; 53/589; 100/31; 140/93.6

[58] Field of Search ..... 100/26, 31; 53/138.6, 53/138.8, 139.4, 589; 140/93.6

[56] References Cited

U.S. PATENT DOCUMENTS

| | | | |
|---|---|---|---|
| 1,417,329 | 5/1922 | Jones | 100/31 |
| 2,087,774 | 7/1937 | Lovette | 100/31 |
| 2,711,278 | 6/1955 | Gray | 100/31 |
| 2,742,851 | 4/1956 | Fryer | 100/31 |
| 3,306,184 | 2/1967 | Hanau | 100/31 |
| 5,121,682 | 6/1992 | Parket et al. | 100/31 |

FOREIGN PATENT DOCUMENTS

| | | | |
|---|---|---|---|
| 602424 | 9/1934 | Germany | 100/31 |
| 50-35876 | 11/1975 | Japan . | |
| 6-48411 | 2/1994 | Japan | 100/31 |
| 1369994 | 1/1988 | U.S.S.R. | 100/31 |

*Primary Examiner*—Stephen F. Gerrity
*Attorney, Agent, or Firm*—Armstrong, Westerman, Hattori, McLeland & Naughton

[57] ABSTRACT

An automatic bundling machine comprises a pair of feed rollers respectively positioned at opposite sides of a band passage; a band-feeding actuator for rotating at least one of the feed rollers; a one-way clutch and a friction clutch mounted between the band-feeding rotary actuator and the feed rollers; a pair of hooks with a band receiving groove formed in an inner surface of the pair of hooks and communicating with the band passage; a flange portion formed on a nose of a rotor for twisting a band, band channels formed on the flange-shaped portion; and a pair of clamps, one end of which are axially supported by the flange-shaped portion and the other end of which are engaged with each of the hooks.

8 Claims, 8 Drawing Sheets

AUTOMATIC BUNDLING MACHINE

BACKGROUND OF THE INVENTION

1. Field of the Invention

This invention relates to an automatic bundling machine for bundling object, such as, electric wires, with a band to keep such object in a firmly clamped state by twisting end portions of the band.

2. Description of the Prior Art

Referring to conventional methods for bundling a plurality of electric wires, or the like, a bundled object is encircled by a band, with a plurality of lateral extending projections thereon. The band end is inserted in a hole of an anchor member for clamping the bundling object. A locking piece provided in the anchor member is locked to a lateral extending projections to keep the object in a firmly clamped state (which is disclosed in the Specification of Japanese Patent No. Sho 50-35876). Regarding to another conventional method thereof, a bundling object is encircled by a deformable band and the ends of such band are engaged with each other and twisted to clamp the object in a firmly clamped state.

The latter above-mentioned conventional bundling method, as shown in FIG. 12, has a bundling machine A wherein a channel 2, for receiving a bundling object W, is formed on the bundling machine body 1. A guiding hook 3 is pivotably mounted adjacent channel 2 (in the left side in respect of FIG. 12), the guiding hook 3 having a cutter 5 and a concave portion 4 which presses the bundling object W, received in the channel 2, when the guiding hook 3 has pivoted toward the channel 2. The bundling machine body 1 also has a pair of feed rollers 7 supplying, toward a gap between the guiding hook 3 and the channel 2, a band 6 compensated by steel cores therein and being deformable in twisting, and a rotation axis 9 rotated by an actuator (not shown), and with a twisting hook 8 at one end of axis 9.

When the bundling machine A bands and clamps a bundling object W, firstly, the feed rollers 7 are rotated to deliver the band 6 by a predetermined length, FIGS. 12 and 13A.

Next, the guiding hook 3 is pivoted to press the band 6 to the bundling object W, whereby the bundling object W can be pinched between the concave portion 4 and the channel 2 and also the band 6, can be cut by a cutter 5, the both ends of the band 6 surrounding the bundling object W and being opposed to each other at each side of the bundling object, FIG. 13B.

Then, by rotating the rotation axis 9, the twisting hook 8 twists the ends of the band 6 so as to make the band 6 band the bundling object W and keep a firmly clamped state, FIG. 13C).

SUMMARY OF THE INVENTION

The aforementioned bundling machine A can band and lamp the bundling object W with a predetermined clamping force when the outer diameter of the bundle of the bundling object W is constant. However, the bundling operation can not be completed in case of the larger outer diameter of the bundle and also the operation can not be completed in case of the smaller outer diameter thereof, which has been a drawback in regard to the bundling machine A.

The present invention aims to solve the above-mentioned problem and provides an automatic bundling machine which, even when outer bundle diameters of bundling objects are different in each bundles, can clamp the bundles with a constant clamping force, each operation of the bundling, the cutting, and the twist-clamping being carried out automatically.

In order to achieve the above-mentioned object, an automatic bundling machine according to this invention comprises:

a case, a band-supply portion having a band-supply in the case, a pair of feed rollers composing of a drive roller and a free roller which are respectively positioned at each side of the band passage, a band-feeding rotary actuator for rotating the drive roller, and a one-way clutch and a friction clutch mounted between the band-feeding rotary actuator and the drive roller;

a bundle converging portion having a pair of hooks provided at one end of the case, and a hook driving actuator which opens and closes the pair of hooks, the pair of hooks being able to be opened and closed, and when closed, a bundling-object receiving space is formed, one end of a band receiving groove, which is formed in a circumferential surface of the receiving space, opposing to the band passage; and a band clamping and cutting portion having a rotor rotated by a band-twisting rotary actuator provided in the case, a band channel being formed at a flange shaped portion formed on the periphery of the forward end of the rotor, the band channel communicating the band passage and one end of the band receiving groove, a pair of clamps, one end of each of which is axially supported by a supporting axis provided in the band passage, the other end of which is engaged with the hook so as to travel forward and backward to the circumferential surface of the rotor according to the opening and closing motion of the hooks, and a cutter traveling forward and backward to the rotor according to the opening and closing motion of one of the hooks.

The one-way clutch may be inserted into a space between a circumferential surface of a sleeve fixed on the output axis of the band-feeding rotary actuator and an inner circular surface of a driving member which transmits a rotation force for the drive roller.

The friction clutch may comprise a concavity formed in a surface of a flange-shaped portion provided on the periphery of the sleeve, a steel ball being inserted in a insertion hole formed in a rotating gear, a spring pressing the steel ball being provided for engaging it with the concavity.

Preferably, a shutter actuator is provided for the pair of hooks, and a shutter for opening and closing the band receiving channel, which traveling along an inner circumstance of the bundling-object receiving space by an operation of a shutter actuator.

Further, when the bundling object W has a small bundle diameter, a transfer limiting member for preventing the bundling object from transferring toward the rotor may be provided in a space between the rotor and the bundling object received in the pair of hooks.

In the bundling operation of the automatic bundling machine comprising the above-mentioned construction for bundling objects, first, the pair of hooks are opened to receive a bundling object. Next, the pair of hooks are closed, which makes the band passage in one case communicate with the band receiving channel of the hooks. In this state, the band-feeding rotary actuator is rotated in the normal direction for supplying a band to rotate the drive roller via the one-way clutch.

The rotation of the drive roller brings the pair of feed rollers to deliver a band, the advancing end of the band in the band passage, via one of the band channels of the rotor, being inserted into the band receiving channel of one of the pair of hooks, and further it being inserted into the other band channel of the rotor via the band receiving channel of the other one of hooks.

In the case where the pair of hooks has a shutter, the shutter is moved to the closed position for covering the band receiving channel so as to prevent the band from getting out of the band receiving channel. After the band is delivered completely, the shutter is returned to the open position.

Next, only one of the pair of the hooks (the one which has accommodated the forward portion of the band) is opened, which makes the clamp engaging to the one of the hooks press the leading end of the band to the circumferential surface of the rotor.

Then, the band-feeding rotary actuator rotates reversely so that the pair of the feed rollers may pull the band toward the opposite direction to the feeding to make the band bundle the bundling object.

After the band has bundled the bundling object, the pull-back tensile force of the pair of feed rollers increases rapidly.

When the tensile force reaches a predetermined value, the friction clutch operates to slip so that the bundling object may be banded with a constant clamping force irrespective of its diameter size.

Next, the one of the pair of hooks is opened, which makes the forward end of the clamp, engaging to the last-mentioned hook, press the band to the nose of the rotor, and then the cutter cuts the band.

Further, as the band-twisting rotary actuator rotates the rotor, the both ends of the bands are rotated together and pinched between the rotor and the clamp so that the band may be twisted to keep the bundling object in a firmly clamped state.

If the bundling object is a bundle of small wires in diameter, the bundling object may be undesirably moved near the rotor when the band is twisted by the rotor rotation. While, if a transfer limiting member is provided, between the rotor and the bundling object received in the pair of hooks, the bundling object can be prevented from its transfer by the transfer limiting member.

BRIEF DESCRIPTION OF THE DRAWINGS

FIG. 11 is a longitudinal sectional view illustrating the transfer limiting member according to this invention and its operational effects to prevent roll-in;

DETAILED DESCRIPTION OF THE PREFERRED EMBODIMENTS

Figure 1:
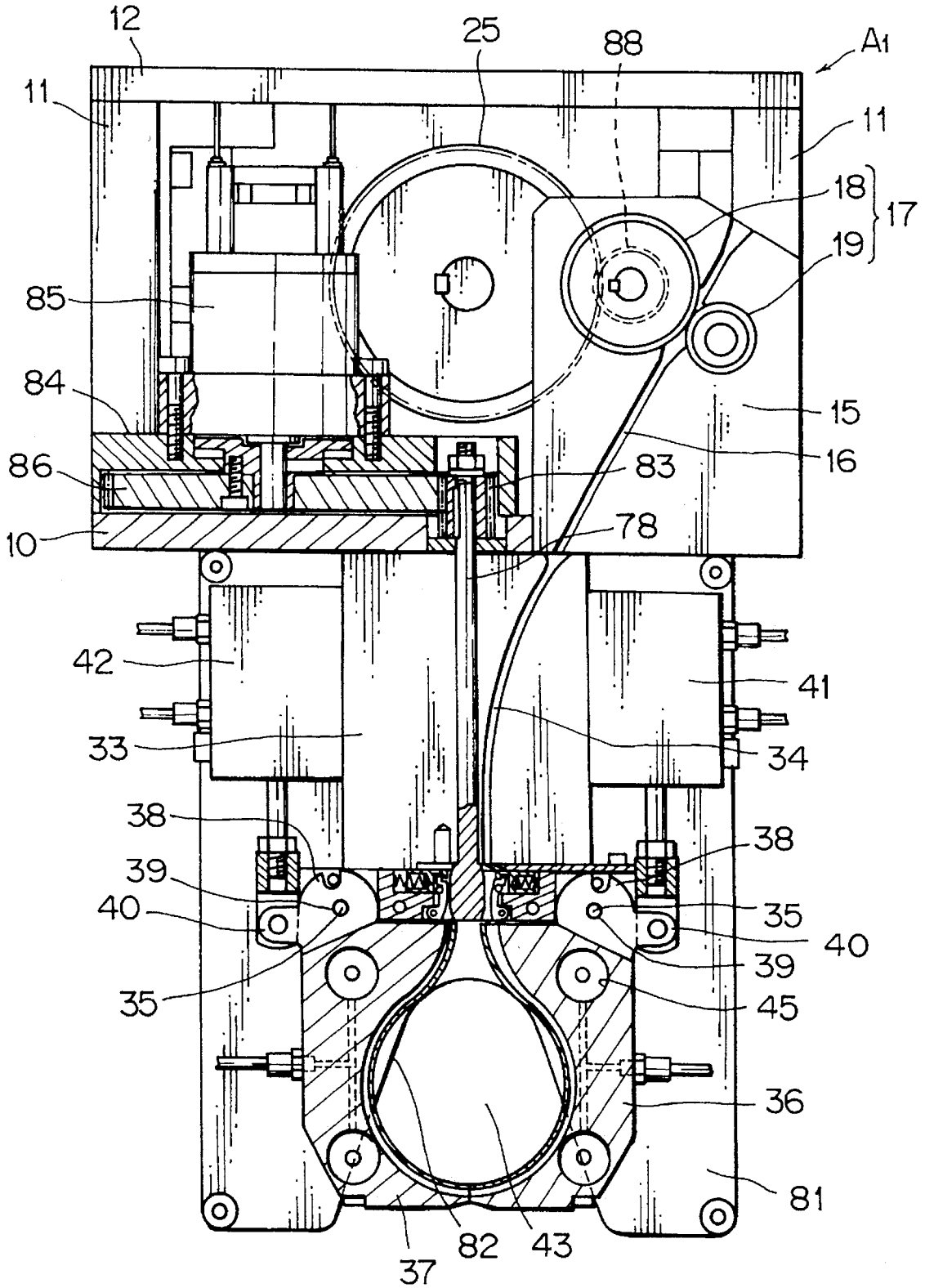
FIG. 1 is a front view of an automatic bundling machine, partly in section, without its cover according to this invention.
Figure 2:
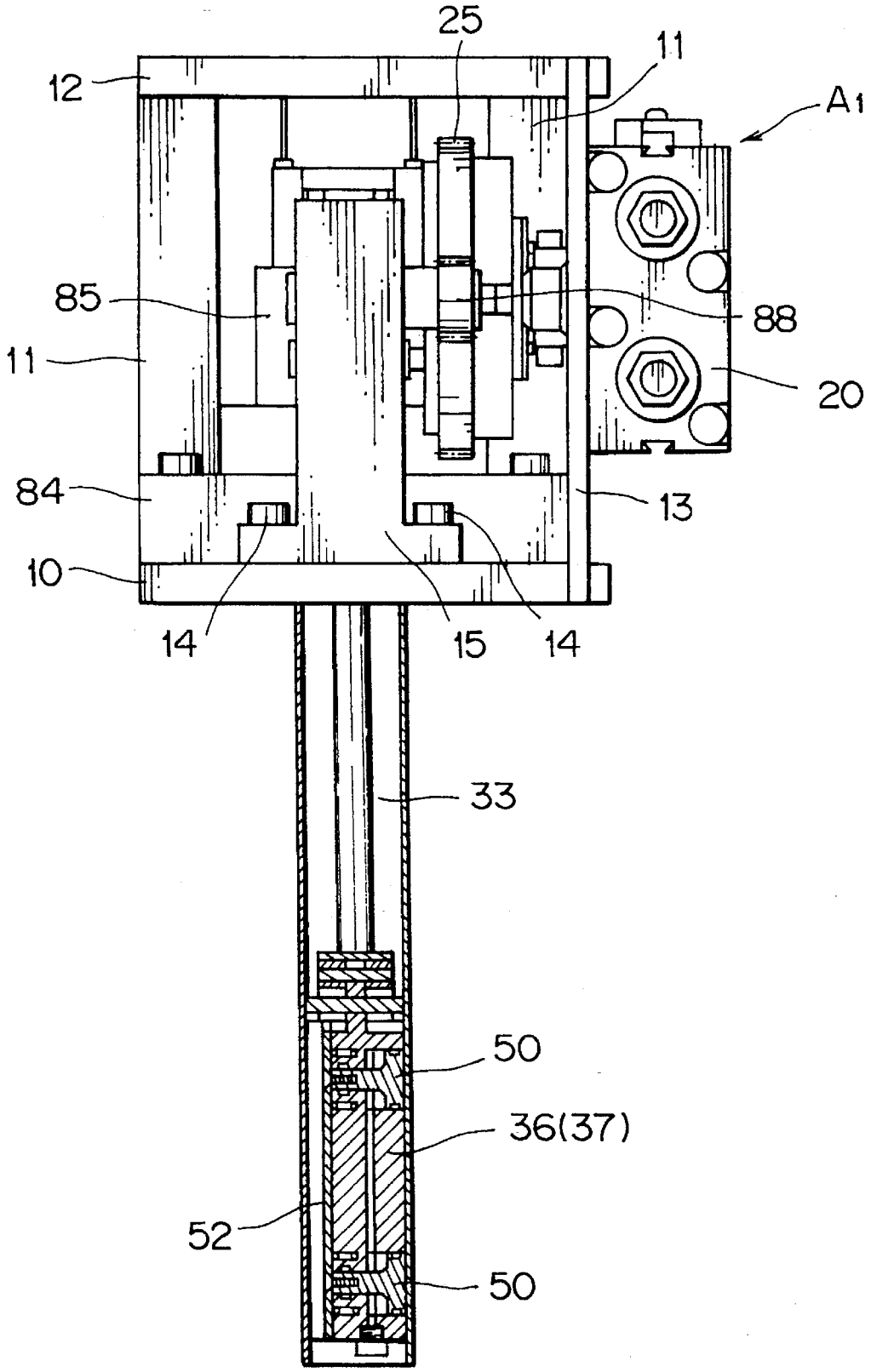
FIG. 2 is a side view, partly in section, in respect of FIG. 1.

Referring to the accompanying drawings in respect of the embodiment of this invention, FIG. 1 is a front view of an automatic bundling machine A1 without a cover according to this invention. FIG. 2 is a side view in regard to FIG. 1, FIG. 3 is a sectional view of a band-supply portion, and FIG. 4 includes front views of a bundle converging portion and a band clamping cutting portion without their cover.

The automatic bundling machine A1, as shown in FIGS. 1 and 2, has a lower plate 10 with rising stays 11 located on the four corners thereof, an upper plate 12 fixed to upper ends of the rising stays 11, and a retainer plate 13 for an actuator fixed at the right side ends of the lower and upper plates 10, 12 in FIG. 2.

In a case 15 fixed on the lower plate 10 by setting bolts 14, as shown in FIGS. 1 and 2, a band passage 16 is provided so as to penetrate diagonally through the case, each of feed rollers 17 composing of a drive roller 18 and a free roller 19 provided at each side of the band passage 16, respectively.

Figure 3:
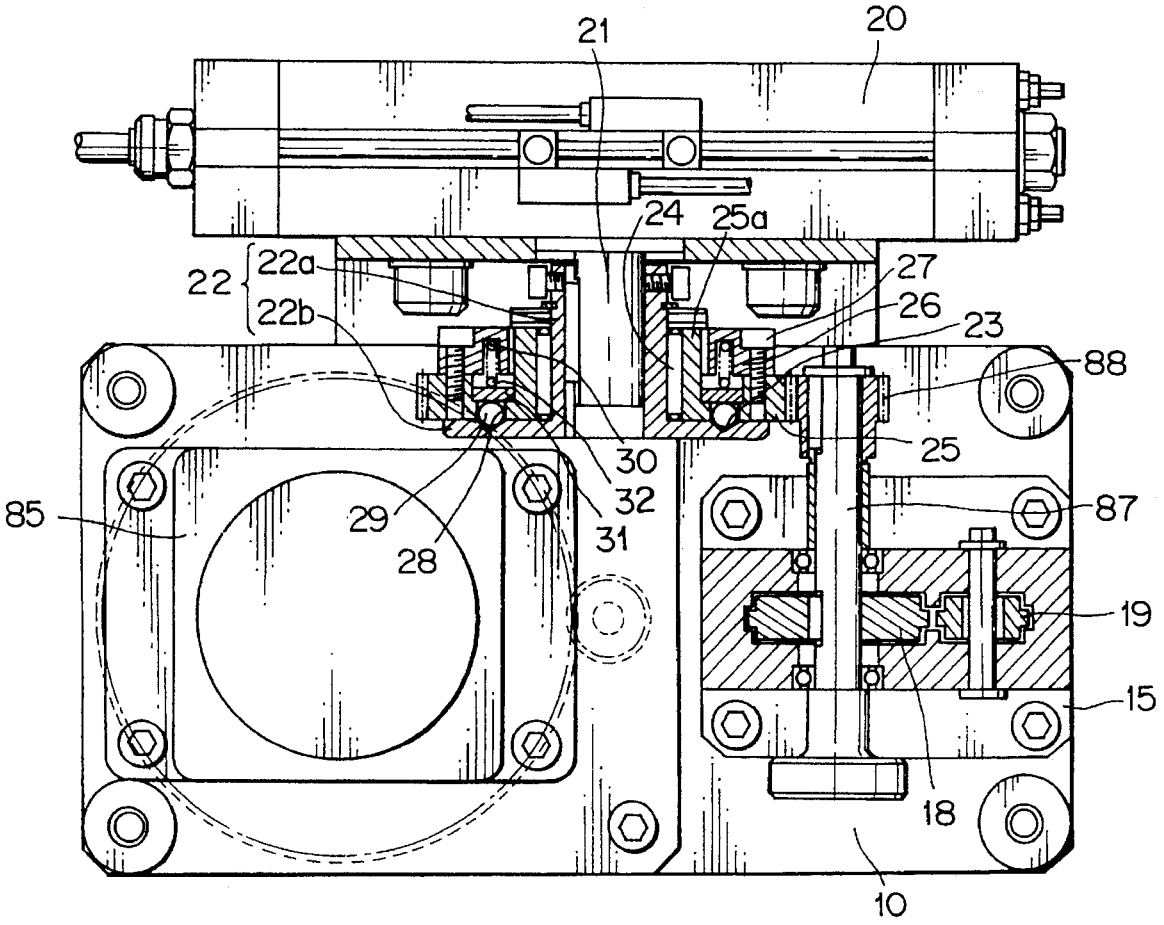
FIG. 3 is a top view, partly in section, of a band-feeding portion according to this invention.

The drive roller 18 is fixed to a drive axis 87, FIG. 3, and the second gear 88 is fixed to one end of the drive axis 87.

On the retainer plate 13 for an actuator, FIGS. 2 and 3, are fixed to a band-feeding actuator 20. A sleeve 22 is fixed on an output axis 21 of the actuator 20 (refer to FIG. 3).

The sleeve 22 has a cylindrical portion 22*a* and a flange-shaped portion 22*b* formed annularly on one end of the cylindrical portion 22*a*, a plurality of recesses 23 being formed in the upper surface of the flange-shaped portion 22*b* in alignment along its circumference (refer to FIG. 3).

Between the circumferential surface of the sleeve 22 and the inner circumferential surface of the cylindrical portion 25*a* of the first gear 25 that is a driving member for the drive roller 18, FIG. 1, a one-way clutch 24, FIG. 3, is inserted.

The first gear 25 engages with the second gear 88 on the upper surface of the first gear 25, a spring retaining plate 26 is fixed by setting bolts 27, FIG. 3.

The first gear 25 has a trough-hole 28 opposing to the recesses 23 of the sleeve 22, a steel ball 29 being inserted into the through-hole 28.

Between a circular groove 30 formed in the lower surface of the spring retaining plate 26 and a ring 31 abutting to the steel ball 29, a spring 32 is inserted.

Thereby, the steel ball 29 is pressed resiliently by the spring so as to engage with the recess 23 of the sleeve 22, which composes a friction clutch between the sleeve 22 and the first gear 25, FIG. 3.

That is, a band-supply portion delivering the band inserted into the band passage 16 to a pair of hooks 36,37 via a lower case 33 which will be described hereafter comprises the above-mentioned construction elements.

Figure 5:
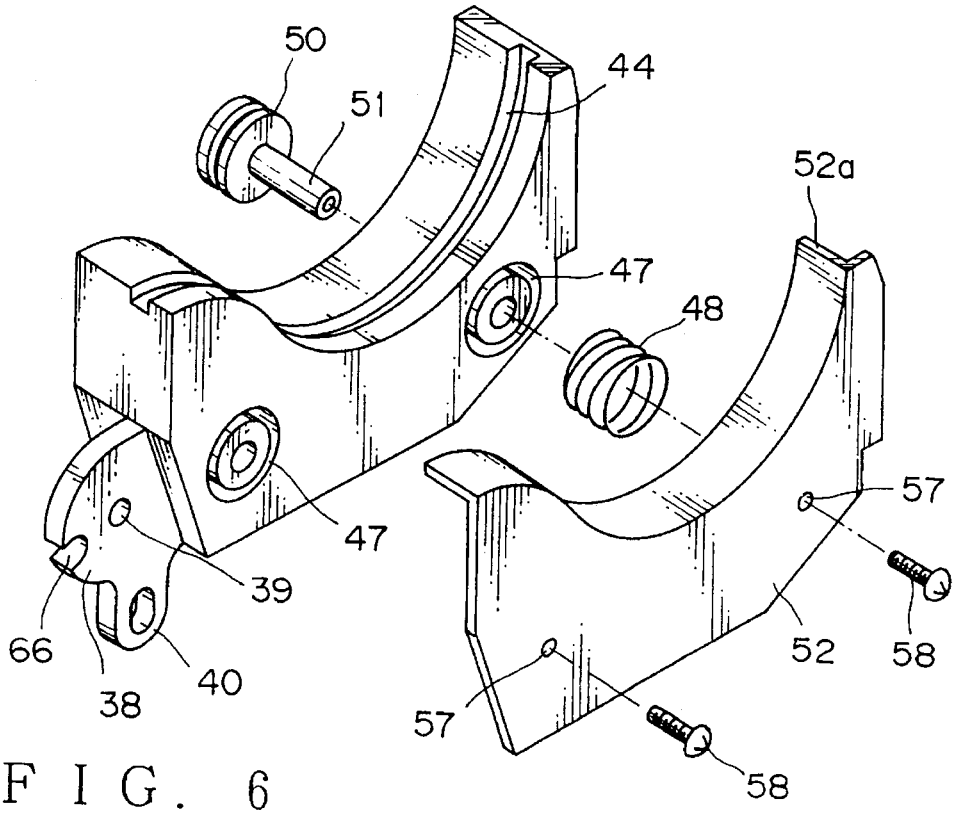
FIG. 5 is an explodes perspective view of one of hooks according to this invention.

In the lower case 33, fitted beneath the lower plate 10, another band passage 34 connecting to the band passage 16 is provided. Each axis 35 being fixed at each of right and left sides of the lower end of the case 33. A pushing projection 38 with a hole 39 pierced therein, FIGS. 1A and 5, is formed on the upper end of each of a pair of hooks 36,37. The axis 35 is inserted into the hole 39.

A connecting projection 40 is formed on the outside of the pushing projection 38, and actuators 41,42 for the hooks are fitted on the right and left side surfaces of the lower case 33, respectively.

In this embodiment, the actuator 41,42 for the hooks are air cylinders and the forward end of the piston rods of actuators 41,42, respectively are axially connected to the connecting projections 40.

Figure 4:
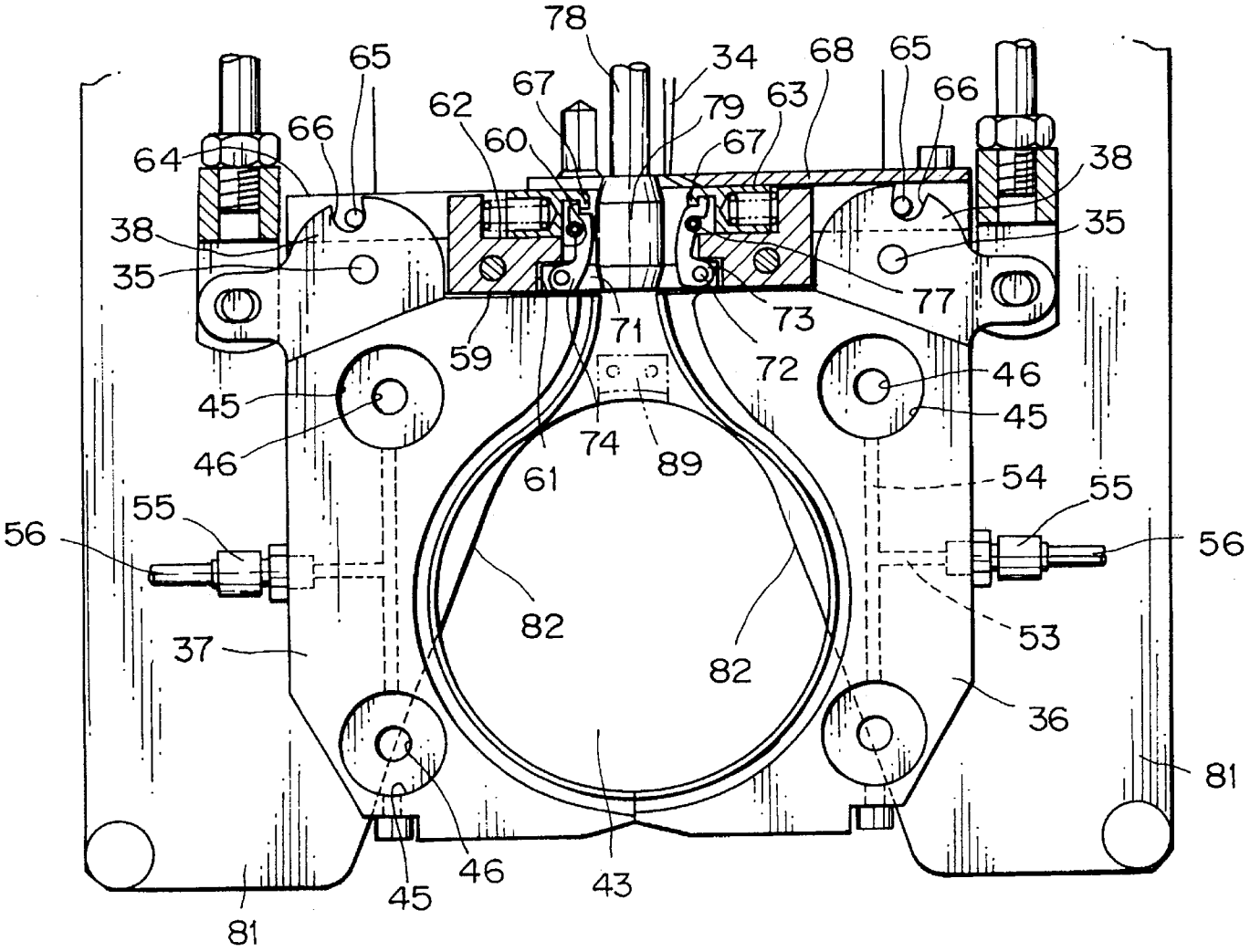
FIG. 4 is front views, partly in section, of a bundle converging portion, a band clamping portion, and a cutting portion without their covers according to this invention.

The actuators 41,42 operate together to advance the piston rods downward, so that the pair of hooks 36,37 pivot to the closing direction around the pivoting axes 35 and form a bundling-object receiving space 43 inside of the closed hooks 36,37 FIGS. 1 and 4.

As the hooks 36,37 are symmetrically formed to each other, referring only to the hook 37 herein, the inner surface of the hook forming the receiving space 43 is provided with a band receiving channel 44, FIG. 5.

When a shutter 52, FIG. 5, is provided to open and close the band receiving channel 44, the following actuator for driving the shutter is furnished.

Figure 7:
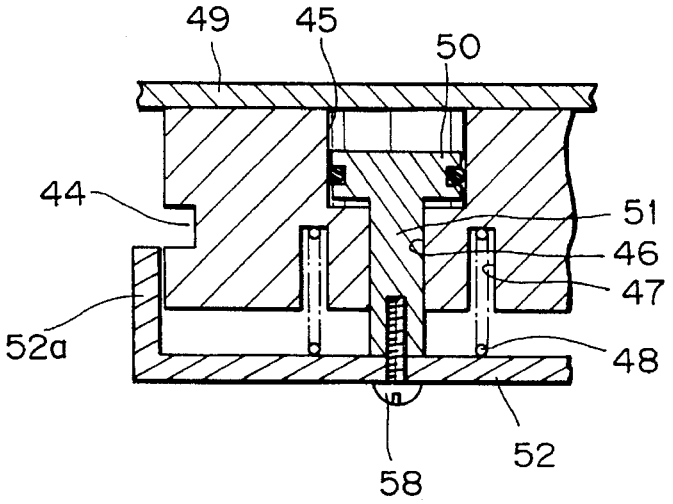
FIG. 7 is a sectional view of a shutter mounted on the hook.

On a couple of portion in one side surface of the hook 37, cylinders 45 are formed, a guide hole 46 with a port on the other surface of the hook being provided to communicate with each of the cylinders 45, a circular channel 47 is provided to surround each of the guide holes 46 and has a spring 48 inserted therein, the cylinder 45 being covered by a cover plate 49, FIG. 7.

The nose of the piston rod 51 of the piston 50 inserted into the cylinder 45 passes through the guide hole 46 to protrude to the outer side. A threaded hole, formed in the nose of the piston rod 51, engages with a screw 58, passing through a small hole 57 provided in the shutter 52 and, as a result, the shutter 52 is fixed to the nose of the piston rod 51, FIG. 5.

As shown in FIG. 4, a pipe passage 53, with a port on the side edge of the hook 37, is connected to an air passage 54 communicating with the cylinder 45, and a pipe joint 55 fitted to the air passage 53 connects to a hose 56 communicating with an air source (not illustrated) via a solenoid valve (not illustrated).

When air is not supplied to the air passage 53, as shown in FIG. 7, the piston rod 51 protrudes so that a bent portion 52*a* on the shutter 52 uncovers the band receiving channel 44. While, when air is supplied to the air passage 53, the piston rod 51 advances into the hook 37, against a resisting force of the spring 48, so that the bent portion 52*a* of the shutter 52 closes the band receiving channel 44.

In FIG. 4, at each side of the pair of hooks 36,37, a guide plate 81 decreasing in width inward and having an inside guide surface 82 to make the bundling object W converge.

That is, a bundle converging portion comprises the construction elements mentioned above.

A clamp supporting case 59, fixed on the lower end surface of the lower case 33, is provided with a through-hole 60 penetrating the middle portion thereof in the vertical direction. The through-hole 60 has an enlarged diameter portion 61 at the lower end thereof. The upper portion of the clamp supporting case 59 is provided with a slide guiding groove 62 which crosses the through-hole 60 in a right angle and has each port on each side surface of the clamp supporting case 59.

Each of the slide guiding grooves 62 receives each of right and left sliding members 63,64. Pins 65 provided on the sliding members 63,64 engage with cam-guiding channels 66 formed on each of the pushing projections 38 of the hooks 36,37.

Consequently, when the pair of hooks 36,37 is opened, the sliding members 63,64 advances to come close to each ether, while, when the hooks 36,37 being closed, the member 63,64 retreats.

The noses of the sliding members 63,64 is provided with an engagement projection 67 engaging with clamps 73,74 mentioned below. On the upper surface of the right side sliding member 63 in FIG. 4, a cutter 68 having a cutting edge at the forward end thereof is fixed.

As shown FIG. 1, a band-twisting rotary actuator 85 is fixed in a gear case 84 fixed on the upper surface of the lower plate 10. A drive gear 86 fixed to the output axis of the band-twisting rotary actuator 85 engages with a free gear 83 fixed on one end of the rotor 78 (an upper end portion in FIG. 1).

The other end of the rotor 78 is provided with a flange-shaped portion 79, on the outer circumferential surface thereof, which is received in the enlarged diameter portion 61 of the through-hole 60.

Band feeding channels are formed symmetrically in a circumferential surface of the flange-shaped portion. The band feeding channel 71 has a supporting axis 72 penetrating the channel 71, the supporting axis 72 being inserted into holes formed on the lower end portions of the clamps 73,74, and an engaging projection 75, FIG. 6 engaging with the engagement projection 67 of the sliding member 63,64 being formed on the upper ends of the clamps 73,74.

Figure 6:
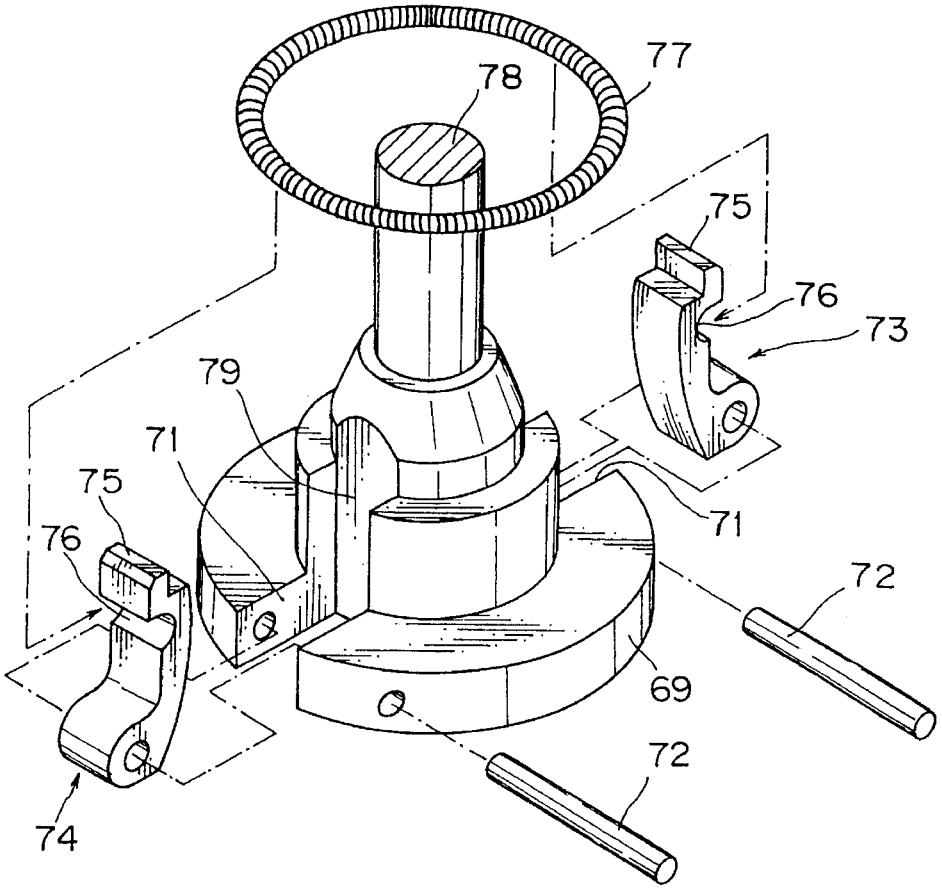
FIG. 6 is an exploded view of a clamp according to this invention.

A spring receiving recess 76, FIG. 6 is formed in a lower side surface of each engaging projection 75. A ring-shaped spring 77 is mounted in each spring receiving recess 76 of the clamps 73,74.

As a result, the clamps 73,74 are forced by the spring, to pivot around the axes 72 so that the each engaging projection 75 may come closer to each other. When the hooks are moved to the open position, the clamps 73,74 are pivoted to incline so as to direct to the center of the rotor insertion hole 70.

That is, a band clamping and cutting portion comprises the above mentioned construction elements.

The operation of the automatic bundling machine A1, having the above-mentioned structure, will be described in the followings, as referring to FIGS. 8A to 8E.

In order to converge bundling objects, at first, the pair of the hooks 36,37 is moved to the open position, and then the bundling object W is inserted into a space between a couple of guiding surfaces 82 of the guide plates 81.

As the guiding surface 82 has such a width decreasing inward, the bundling object may be compressed to be bundled with ease.

Figure 8E:
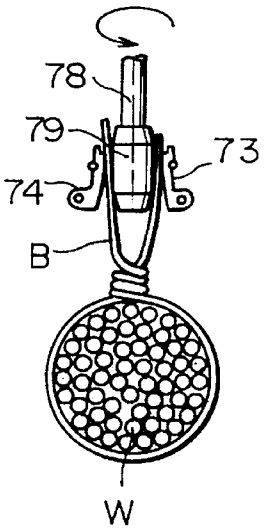
FIGS. 8A to 8E are views illustrating the operation of the automatic bundling machine.
Figure 8C:
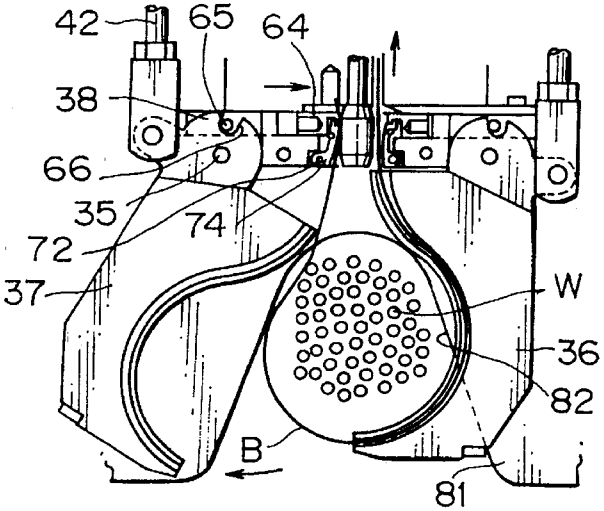
Figure 8D:
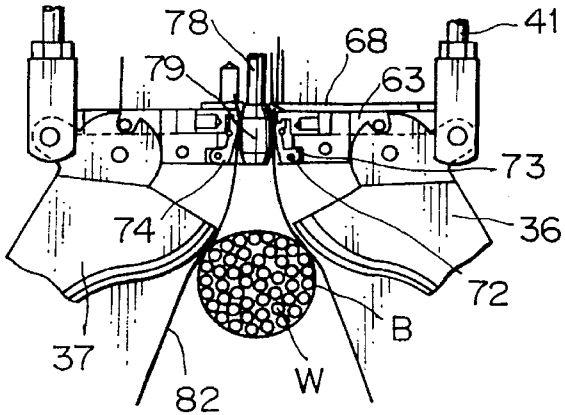
Figure 8A:
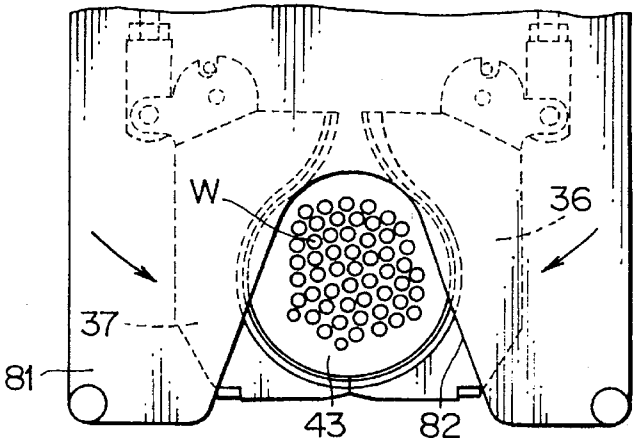

Next, the pair of hooks 36,37 is moved to the closed position, and thereby the bundling object is accommodated in the receiving space 43 formed by the hooks 36,37, FIG. 8A.

According to the closure of the pair of hooks 36,37, a band passage 34 in the lower case 33, which connecting to a band passage 16 of the case 15, communicates with a band receiving channel 44 of the right side hook 36 via a band guiding channel 71.

Further, one end of the band receiving channel 44 of the hook 36 communicates with the band receiving channel 44 of the hook 37, and one end of the band receiving channel 44 of the hook 37 communicates with the band guiding channel 71.

In this state, when the band-feeding rotary actuator 20 is rotated in the normal direction, the first gear 25 rotates in the normal direction via the one-way clutch 24, the second gear 88 engaging with the first gear 25 being rotated in the normal direction, and the drive roller 18 being rotated in the band feeding direction.

Figure 8B:
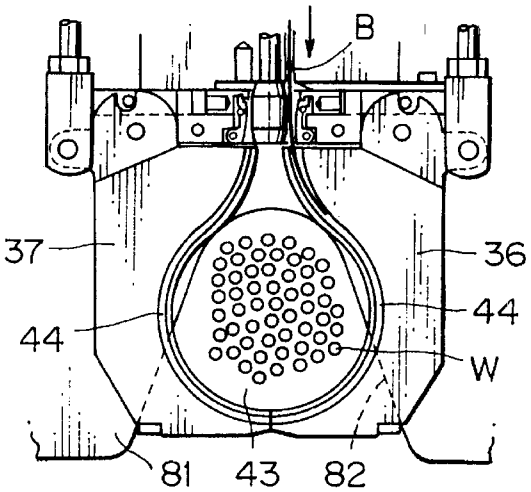

The leading end of the band B which is pinched by the drive roller 18 and the free roller 19, via the band passages 16,34 and the band guiding channel 71, is delivered to the band receiving channel 44 of the hook 36, FIG. 8B. Further, it passes through the band receiving channel 44 of the hook 37 and is inserted into the band receiving channel 71.

If each of the hooks 36,37 has a shutter 52, the band 3 is prevented from getting out of the band receiving channel 44 by moving the shutter 52 to the closed position which covers the band receiving channel 44.

After the band B is fed completely, the shutter 52 is returned to the open position.

Next, by operating the actuator 42 for actuating the hooks, only the hook 37 having received the forward end of the band B (the left side hook in FIG. 8C) is moved to the open position, and thereby the cam-guiding channel 66 of the hook 37 pushes the pin 65, and the left side sliding member 64 advances toward the rotor 78.

In accordance with the advance of the left side sliding member 64, the clamp 74 engaging with the° engagement projection 67 of the sliding member 64 pivots clockwise around the support axis 72 so as to press the forward end of the band B against the circumferential surface 79 of the rotor 78, FIG. 8C.

Next, the band-feeding rotary actuator 20 is rotated adversely, and, thereby the pair of feed rollers 17 composing of the drive roller 18 and the free roller 19 draws the band B in the opposite direction to the feeding so that the band B may bundle the bundling object W.

After the band B has fully bundled the bundling object, the adverse tensile force by the pair of feed rollers 17 increases abruptly.

When the adverse tensile force has reached to a certain tensile force, the steel ball 29 having engaged in the recess 23 can get out of it. Thereby, the first gear 25 can slip against the rotation of the sleeve 22 so that the bundling object may be bundled with a specific clamping force irrespective of bundle diameters of bundling objects W.

Next, the right-hand hooks 35 is moved to the open position. Thereby, the cam-guiding channel 66 of the hook 36 pushes the pin 65 on the right-hand sliding member 63, the sliding member 63 being advanced toward the rotor 78, the right-hand clamp 73 being pivoted counterclockwise around the supporting axis 72 so as to press-contact to the band B, and also the cutter 68 being advanced to cut the band B, FIG. 8D.

Then, the band-twisting rotary actuator 85 is rotated. The rotation is transmitted to the rotor 78 via the drive gear 86 and the free gear 83, the circumferential surface 79 of the rotor 78 and the clamps 73,74, which have pinched the band B therein, being rotated in a unitary body so as to twist the both band ends, so that the bundling object W can be kept in a firmly clamped state, FIG. 8E.

Next, the pair of the hooks 36,37 is moved to the close position, which releases the clamp 73,74, the both ends of the band B having clamped the bundling object being also released from the both clamp 73,74 and the nose 79 of the rotor 78. As a result, the bundling object can be taken out from the bundling machine.

The automatic banding of the bundling object W in use of the band B has been completed by the above-mentioned operation.

Figure 9:
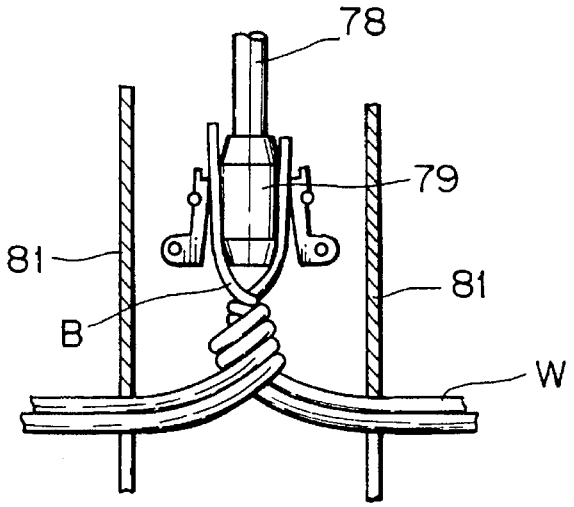
FIG. 9 is a view illustrating the state of a bundling object bundle with an extreme small diameter.

In case that a bundle diameter of the bundling object W is extremely small (for example, when the bundling object W is composed of a couple of 0.3 sq wires), the bundling object W itself is easily deformed in twisting. Therefore, when the band B, having banded the bundling object W, is twisted by the rotation of the rotor 78 and the clamps 73,74, there is an undesirable possibility that the bundling object W may be rolled in the band B and twisted together with the band B, FIG. 9.

Figure 10:
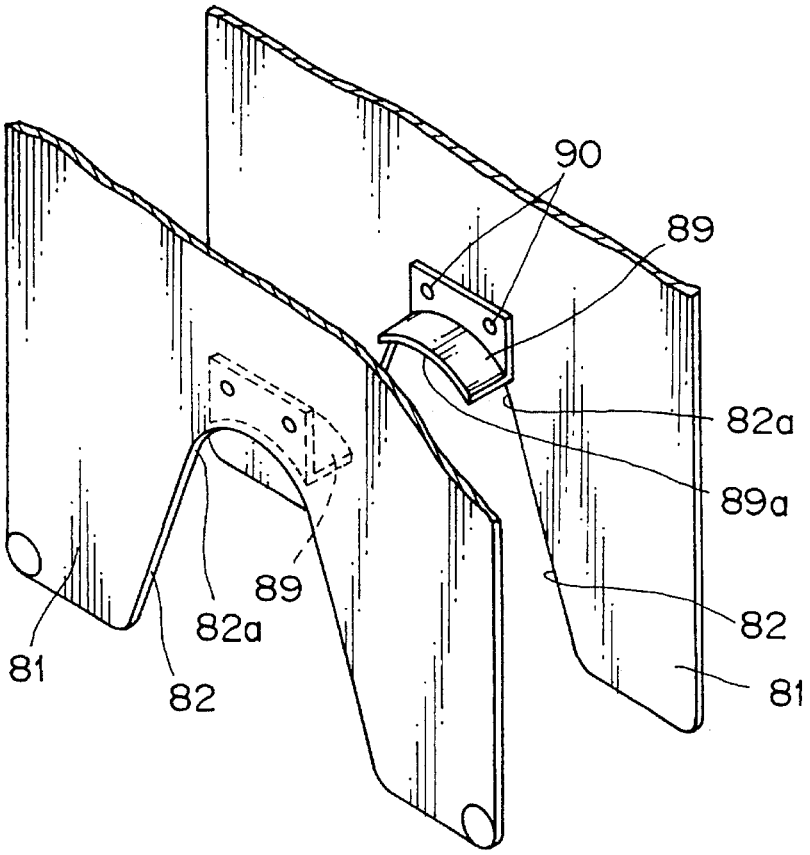
FIG. 10 is a perspective view of a transfer limiting member according to this invention and mounted on a guiding plate.
Figure 13A:
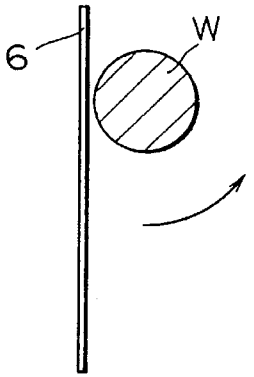
FIG. 13A PRIOR ART
FIGS. 13A to 13*c* are diagrammatic illustrations of a conventional banding operation.
Figure 13B:
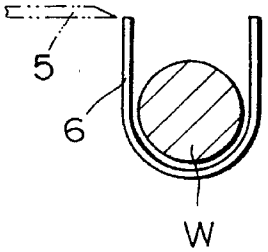
FIG. 13B PRIOR ART
Figure 13C:
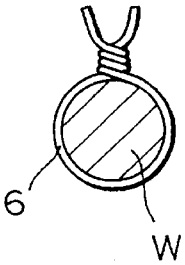
FIG. 13C PRIOR ART
Figure 12:
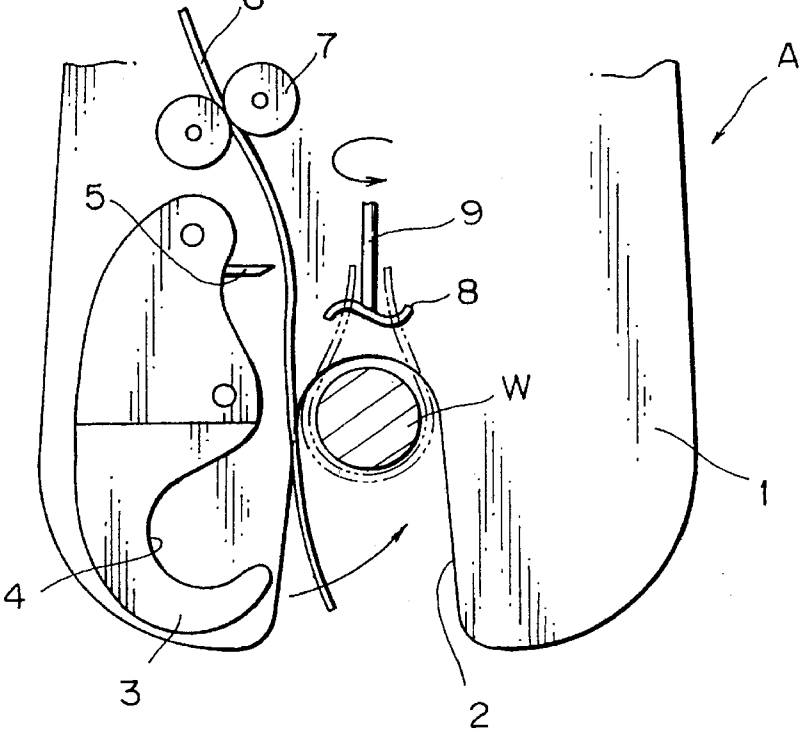
FIG. 12 PRIOR ART
FIG. 12 is a schematic diagram illustrating a conventional bundling machine.

In order to prevent the bundling object W from being rolled in, as shown in FIG. 10, a transfer limiting member 89 is provided and fixed by set screws 90 on the inner surface of the guiding plate 81 positioned at both sides of the pair of hooks 36,37.

The transfer limiting member 89 has a limiting surface 89*a* of a concavity facing to the open side of the guide surfaces 82 of the guiding plates 81, and the limiting surfaces 89*a* are positioned substantially just on the saddle portion 82*a* of the guiding surface 82.

Figure 11:
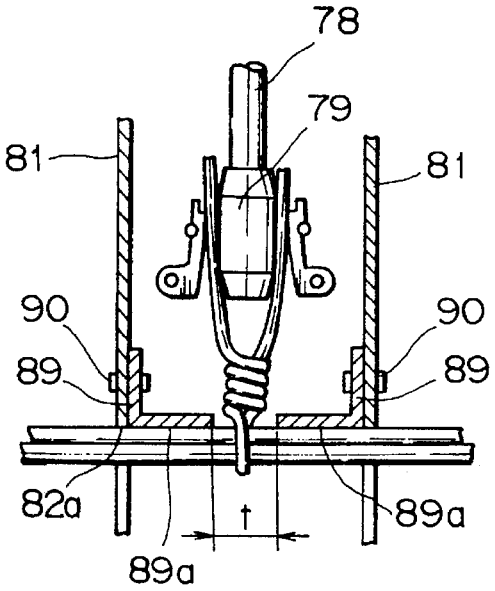

In the operation of this transfer limiting member 89, when the rotor 78 rotates to twist the band B. the transfer limiting member 89 prevents the bundling object W from being rolled in the twisted band W, FIG. 11.

In order to get the best limitation effect in the transfer limiting member 89, the gap between a couple of the transfer limiting members 89 shall be as narrow as possible with allowing the band B to pass therein to prevent the bundling object W from being rolled in.

As this invention is constructed as mentioned above, a series of operations of the band feeding, the bundling of the bundling object with the band, the cutting of the band, and the twisting process of the both band ends are carried out automatically with high efficiency.

Further, irrespective of bundle diameters of bundling objects, it is possible that the bundling objects are bundled with a predetermined constant clamping force.

What is claimed is:

1. An automatic bundling machine comprising:

a case, a band-supply portion having a band passage in said case, a drive roller and a free roller positioned at opposite sides of said band passage, a band-feeding rotary actuator for rotating said drive roller, and a one-way clutch and a friction clutch mounted between said band-feeding rotary actuator and said drive roller;

a bundle converging portion having a pair of hooks at one end of said case, and a hook driving actuator for opening and closing said pair of hooks, said pair of hooks, when closed, forming a bundling-object receiving space, a band receiving groove having one end formed in a circumferential surface of said receiving space, opposed to said band passage; and a band clamping and cutting portion having a rotor rotated by a band-twisting rotary actuator in said case, a band channel at a flange-shaped portion on the periphery of a forward end of said rotor, said band channel connecting said band passage and one end of said band receiving groove, a pair of clamps, one end of each of said clamps being axially supported by a supporting axis in said band channel, the other end of said clamps being engaged with said hook so as to travel forward and backward to the circumferential surface of said rotor according to the opening and closing motion of said hooks, and a cutter traveling forward and backward to said rotor according to the opening and closing motion of one of said hooks.

2. An automatic bundling machine as claimed in claim 1, wherein said one-way clutch is in a space between an outer circumferential surface of a sleeve fixed on an output axis of said band-feeding rotary actuator and an inner circular surface of a driving member for transmitting a rotation force for said drive roller.

3. An automatic bundling machine as claimed in claim 1, wherein said friction clutch comprises a concavity formed in a surface of a flange-shaped portion on a periphery of a sleeve fixed on an output axis of said band-feeding rotary actuator, a steel ball being inserted in an insertion hole formed in a driving member for transmitting a rotation force for said drive roller, a spring pressing said steel ball for engaging said steel ball with said concavity.

4. An automatic bundling machine as claimed in claim 1, further comprising a shutter actuator for said pair of hooks, and a shutter for opening and closing said band receiving groove, said shutter traveling along an inner circumferential surface surrounding said bundling object receiving space in accordance with the operation of said shutter actuator.

5. An automatic bundling machine as claimed in claim 1, wherein a transfer limiting member, for preventing a bundling object from transferring toward said rotor, is positioned in a space between said rotor and said bundling object received in said pair of hooks.

6. An automatic bundling machine as claimed in claim 1, wherein said band-feeding rotary actuator can rotate in reverse so that said pair of feed rollers pulls a band in an opposite direction.

7. An automatic bundling machine as claimed in claim 1, wherein said bundle converging portion comprises a guide plate having a guide surface decreasing inward in width for making a bundling object converge inward.

8. An automatic bundling machine as claimed in claim 1, wherein a ring-shaped spring is mounted in spring receiving recesses formed in said clamps so that said clamps may be forced by said spring to come close to each other.

* * * * *